United States Patent [19]

Fischer

[11] 4,413,562

[45] Nov. 8, 1983

[54] CHAIN-TYPE TRANSPORT APPARATUS, FOR USE WITH PRINTING MACHINES

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 360,066

[22] Filed: Mar. 22, 1982

[30] Foreign Application Priority Data

Apr. 10, 1981 [DE] Fed. Rep. of Germany ..... 3114581

[51] Int. Cl.[3] ..... B41F 1/30; B65H 29/04

[52] U.S. Cl. ..... 101/408; 271/204; 271/277

[58] Field of Search ..... 101/408, 232, 246; 271/204, 206, 277

[56] References Cited

U.S. PATENT DOCUMENTS 2,828,689 4/1958 Ritzerfeld et al. ..... 101/232
3,076,492 2/1963 Monks ..... 271/204

FOREIGN PATENT DOCUMENTS 2638783 3/1978 Fed. Rep. of Germany ..... 271/277
147015 9/1954 Sweden ..... 271/204

*Primary Examiner*—E. H. Eickholt
*Attorney, Agent, or Firm*—Frishauf, Holtz, Goodman & Woodward

[57] ABSTRACT

To prevent uncontrolled movement or flutter of a trailing end of a sheet being removed by a chain conveyor from a delivery drum (7) of a printing system (1), the sheets are gripped by grippers (10) connected to cross struts (9) of two chains (8), and engaged by sheet engaging brushes (19, 22) or rollers or ducts (30, 34) with differential pressure application, such as compressed air, to urge the sheets against a sheet guide vane (13) or strip. To prevent interference with the grippers (10) on the chain conveyor, the sheet guide elements are lifted off from the sheets upon passage of the grippers by a cam-cam follower arrangement. The cams may be secured to the gripper structures in the form of cam curves (11), engaged by cam followers (17, 22) which pivot or tilt cross rods (15, 20) to lift the brushes off the sheets; or a cam (25; FIG. 2) can be placed on the delivery drum, controlling cam followers (27, 31) which, over a linkage, lift off the engagement elements (30, 34) when the grippers come therebeneath, but permit engagement thereof when the grippers have passed, to control movement of the trailing portions of the sheet.

10 Claims, 2 Drawing Figures

CHAIN-TYPE TRANSPORT APPARATUS, FOR USE WITH PRINTING MACHINES

Figure 1:
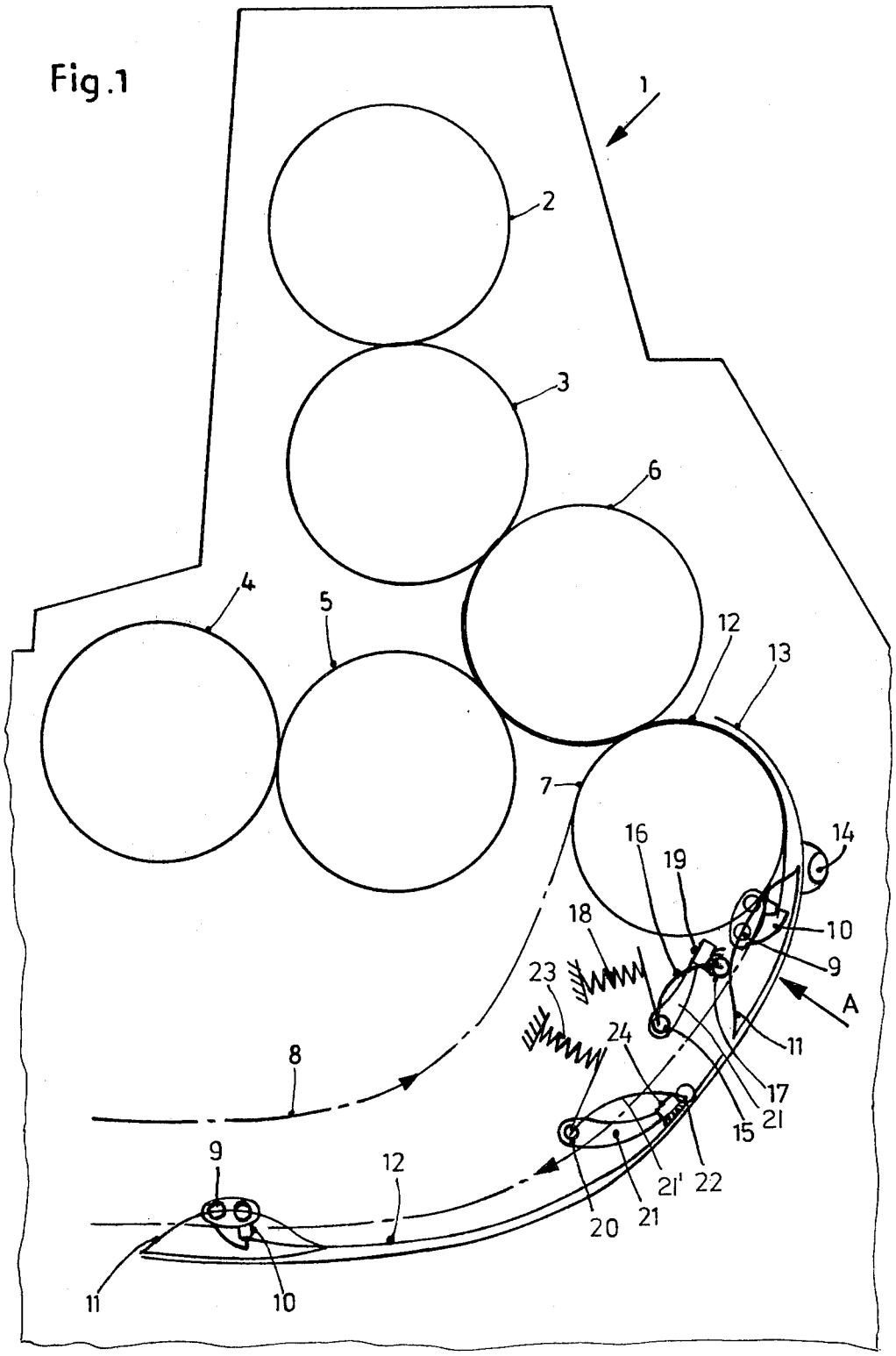

The present invention relates to a transport apparatus for sheets of a sheet-fed printing machine and more particularly to a chain transport mechanism to remove sheets from a printing system to a delivery station.

BACKGROUND

Chain-type conveyor or transport system for sheets, to be used with a sheet-fed printing machine known, see, for example, German Patent Disclosure Document DE-OS 29 44 227. This publication shows a chain transport system which has a sheet brake associated therewith, formed, essentially, by a pipe or roller to which suction is applied. The pipe or roller, located below the chain is provided to stiffen the leading edge of the sheet which is gripped by the grippers. The suction element is located adjacent the deposition point to permit accelerated removal of the sheet, since, as the gripper releases, the weight of the sheet causes it to drop to the suction roller. The suction roller is located in a horizontal sheet guide range beneath the chain transport system.

THE INVENTION

It is an object to improve sheet transport chain systems and more particularly to prevent uncontrolled movement of the trailing edge of the sheet which is transported by chain conveyor systems.

Briefly, means are provided to prevent creasing, rolling or flutter of the trailing portion of the sheet, or other uncontrolled movement thereof which includes movable sheet guide elements adapted to engage the sheet after it has been gripped. The sheet guide elements are movable out of gripping position when the grippers pass the elements, and are moved into engagement position thereafter, for example, to cause the sheet to contact a guide vane, guide strip or the like, and thus prevent uncontrolled movement of the trailing portion thereof. The sheet guide element may be a brush, pad, or may include differential suction apparatus, such as a compressed air nozzle, suction nozzle or the like. Preferably, movement of the movable sheet guide element is controlled by a cam, the sheet guide element itself carrying a cam follower. The cams themselves can be located on the gripper mechanism so that, as gripper mechanisms pass the sheet guide element, the cam follower thereon becomes engaged thereby to move the sheet guide element out of position where it might interfere with the grippers; in accordance with another feature of the invention, the cam is located on a delivery drum which forms part of the printing machine. Since the cam, regardless of where located, will move in synchronism with rotation of a rotor, drum, or cylinder of the printing machine, movement of the sheet guide element is controlled in synchronism therewith so that synchronized movement also with the sheet being transported or conveyed by the chain is obtained.

The arrangement has the advantage that the sheet, which is gripped at its leading edge by grippers, as customary and known, cannot fold over in itself, roll in itself, or collapse as the trailing edge loses contact with the sheet delivery drum. The rhythmic, synchronized movement of the sheet guide elements can be so controlled that the trailing portion of the sheet, for example the end portion, is displaced for engagement with a sheet guide vane, or similar element thus stretching the sheet and flattening it, so that uncontrolled waving operation, or flutter of the sheet is prevented.

DRAWINGS

Figure 2:
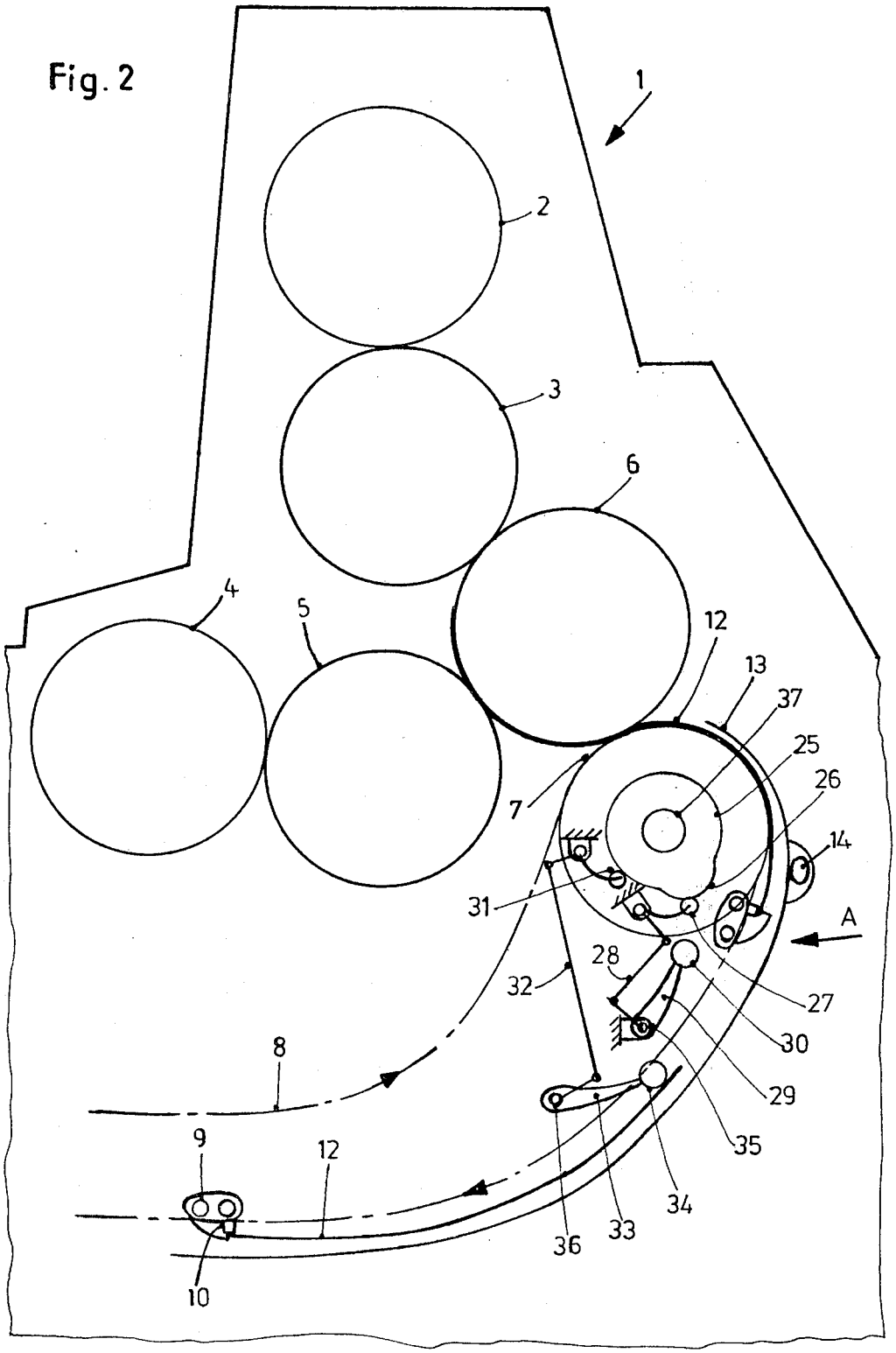

FIG. 1 is is a schematic side view of a rotary sheet-fed offset printing machine having a delivery drum and a chain system associated therewith to remove printed sheets, in which all elements not necessary for an understanding of the invention are shown only in schematic representation; and FIG. 2 is a view of a rotary offset printing machine similar to FIG. 1 illustrating another embodiment.

The printing machine shown in FIGS. 1 and 2 has a printing station 1 which is constructed in customary form in accordance with any suitable design. It has two pairs of plate-rubber blanket cylinders 2, 3 and 4, 5. A sheet fed to station 1, for example from a make-ready table or from another printing system, is guided around a printing or impression cylinder 6 for application of printed subject matter thereto in two colors, one from each printing system 2, 3; 4, 5. Inkers and dampers have been omitted for clarity of the drawing. The sheet, after having been passed around the impression cylinder 6, is applied to a delivery drum 7, for subsequent transport by a transport chain 8 to a delivery station or to another printing system, that is to deliver the sheet to an external apparatus (not shown).

Two chains 8 are provided, one each being positioned at an axial end of the drum 7, as is customary. The chains are connected by cross elements or cross struts 9 on which sheet grippers 10 are located, in customary and usual construction (see FIG. 1), designed to grip a sheet at its leading edge upon transfer from drum 7. The struts line can be constructed in any suitable manner, for example in form of a gripper spindle which, as known, is located parallel to the gripper engagement surfaces.

A sheet 12, gripped by the grippers 10, is first guided through a sheet delivery zone A, after having been taken over from the delivery drum 7. In transport systems of this type, and upon high speed operation, the trailing end of the sheet may be flopped over or rolled-in, particularly when handling film or low gauge sheets, the sheet may also collapse within the trailing portion thereof, or flutter, or more in waves, in short, causing undesired and disturbed turbulent movement. Irregularities of transport of this type have a damaging effect on the printed image being transferred to the sheet. The printing systems 2, 3; 4, 5 have just applied fresh ink to the sheet, and particularly upon snapping or whipping of the sheet, damage to the printed subject matter as well as damage to the sheet itself may occur.

In accordance with the present invention, damage to the sheet is effectively prevented by providing means to stiffen the trailing end of the sheet as it is transported away from the printing station by engaging the sheet against vanes, or shrouds 13, which, customarily, are located beneath the transport chains, supported on cross braces 14, or the like.

A cross brace or cross rod 15, for example in form of a rotatable rod is provided. The brace 15 can be located or journaled in the usual side walls (not shown) of the machine in any suitable manner. A pivot lever 16 is securely connected to the cross rod 15. The pivot lever 16 carries a roller 17 at its end. A spring 18 is positioned to bias the cross rod or brace 15, and thus the lever 15 with the roller 17 thereon in clockwise direction.

In accordance with a feature of the invention, cam curves 11 are secured to the cross struts 9, to be engaged by the roller 17. The cams 11 and the roller 17 thus form cooperating cam-cam follower combinations. The curves 11 may also be secured to the gripper spindles if the gripper structure 9, 10 so provides.

OPERATION

A sheet 12, gripped by the gripper spindles, is moved by the chain 8. As the bar 9 passes the roller 17, the roller 17 will be engaged by the cam curve 11, and pivoted in counterclockwise direction. This causes tipping towards the left (FIG. 1) of the lever 16. A lever 21 carries small pads, for example in the form of brushes 19, which, then, likewise will be tipped by rod 15 in counterclockwise direction. This ensures that the brushes 19 will not slide or drag over the grippers 10, causing premature wear thereon as well as damage to the grippers 10 or the bars 9. Additionally, the tipping movement of the small brushes upon return causes gentle engagement of the brushes 19 with the sheet 12 to effect braking thereof by pressing the sheet 12 in the direction of the guide vane or guide shroud 13. This ensures that the sheet is guided reliably and free from flutter, whip-lash movements or creasing, rolling in or kinking. The trailing end of the sheet no longer can roll against itself, and cannot flip over.

Sheet guidance by the conveyor chain can additionally be improved by locating a plurality of similar arrangements parallel to the bar 15 with levers 16 and brushes 19 thereon downstream of the conveyor. FIG. 1 illustrates a second cross bar 20, carrying levers 21 with cam followers 22 thereon in the form of rollers, urged by a spring in clockwise direction. The roller 24, like roller 17, runs over the cam curve 11 to lift a brush, or pad carried by the lever 21 off the sheet when engaged by curve 11. The roller 22, itself, which is secured to a lever 16', and the brush carried by a separate lever 21 is attached to the cross rod 20. A similar construction is shown in connection with brush 19, carried by lever 21.

The brushes 19, secured to their own support levers 21, preferably can be moved transversely to selected positions on the cross rod 15 so that they are positioned over regions of the sheet which do not carry printed subject matter. Other equivalent elements may be used, such as small rollers, pads, slider springs or the like.

The embodiment of FIG. 2 is, in general, similar to that of FIG. 1; the difference is in the control of the sheet guide elements. Rather than using the gripper structures to control movement of the sheet guide elements by cam 11 secured to the respective grippers, a cam disc 25 having a cam projection 26 is secured to the shaft 37 of the delivery drum 7. The cam disc 25 rotates with drum 7, so that rotation of the drum 7 and of the cam disc 25 is strictly synchronized. Placing cam 11 on the grippers, of course, results in automatic synchronization of any engaging and disengaging movement of the sheet guide elements, such as the brushes 19. A cam follower 27 is in engagement with cam disc 25 which acts on a pivot lever 29 over a linkage 28, shown only schematically. The pivot lever 29, at its end, carries a differential air pressure roller 30. Similar to the arrangement of FIG. 1, additional such rollers can be placed downstream of the air roller or pipe 30, for example shown as including an air pipe 34, supported on a pivot lever 33 and pivotable over a shaft 36 and having its movement controlled over a lever arrangement 32 which, in turn, is moved by a cam follower 31 also riding on the cam disc 25.

The levers 29, 33 are fixed to respective cross rods 35, 36.

OPERATION

Upon rotation of curve disc 25, the rollers or pipes 30, 34 are so controlled in their movement that they are lifted off close contact with the sheet 12 being gripped by the grippers when the grippers pass the respective rollers; after the grippers have passed, the rollers 30, 34 are pivoted in clockwise direction to move towards the sheet 12, thus pressing the rollers against the guide vanes or strips or the guide shroud 13, independent of its construction. The sheets, thus, fall within the operating range of the differential air pressure caused by the rollers 30, 34, respectively, thus substantially increasing the reliability and direction of sheet guidance. A relatively small quantity of differential air pressure, applied to the rollers, ensures tight and smooth guidance of the sheet. Collapse of the sheet, flip-over or roll-in of the end portion of the sheet is thereby effectively prevented.

The pivoting movement of the sheet guide element may be replaced by linear movement thereof; pivoting movement, however, has an advantage in that it is simple to construct and easy to control. Linear movement is more complex since it must be so controlled that the sheet guide elements, upon passage of the grippers, are retracted and thereafter are pushed towards the sheet 12. A reciprocating movement is more difficult to command and guidance of the elements is more complex.

Various changes and modifications may be made, and features in connection with one embodiment may be used with the other, within the scope of the inventive concept.

What is claimed is:

1. Sheet transport apparatus for a sheet-fed rotary printing machine having a drum, or cylinder (7) from which a sheet (12) is to be transported, and defining a sheet delivery zone (A) adjacent thereto;

two endless transport chains (8) located at axial ends of the drum or cylinder;

cross struts (9) connecting the chains, located at spaced intervals thereon;

sheet grippers (10) located on the cross strut to grip the leading edge of the sheet (12) to be transported;

and comprising in accordance with the invention means to prevent creasing, rolling-over or other uncontrolled movement of the trailing end of the sheet being transported comprising movable sheet guide elements (19, 22, 30, 34) located at least in said sheet delivery zone (A) and extending at least in part transversely to the movement of the sheet as it is being transported;

and movement control means (11, 16, 17; 25, 26, 27, 28) connected to and controlling movement of said movable sheet guide elements, in synchronism with rotation of the drum, or cylinder (7) between an inoperative position when the grippers (10) on the chain pass beneath said sheet guide elements and an operative position thereafter in which said sheet guide elements move to operative engagement with the portion of the sheet behind the leading end thereof gripped by said grippers, to control the position of said portion of the sheet on the chain conveyor.

2. Apparatus according to claim 1, further including at least one sheet guide vane (13) located in said sheet delivery zone, and positioned to control the location of a sheet being removed from said drum or cylinder (7) and extending in a guide path parallel to said chain, the sheet guide elements (19, 22, 30, 34) urging the sheet (12) against said guide vane for controlled movement of the sheet along said guide vane.

3. Apparatus according to claim 1, wherein the sheet guide elements comprise brushes (19).

4. Apparatus according to claim 1, wherein the sheet guide elements comprise differential air pressure rollers (30).

5. Apparatus according to claim 1, further including a cross rod or carrier (15, 20; 35, 36) extending transversely of the two endless transport chains (8);

and holder links (21; 29, 33) supporting said sheet guide elements (19, 20; 30, 34) at one end thereof, the holder links being slidably adjustably positioned on said cross element (15, 20; 35, 36).

6. Apparatus according to claim 1, further including a pivoting cross bar (15, 20; 35, 36) operatively coupled to said movement control means, and carrier links (21; 29, 33) secured to said pivoting cross bars at one end and carrying, at the other end, the movable sheet guide element (19, 22; 30, 34), the movement control means controlling rocking, pivoting movement of said pivoting cross bar to thereby move said sheet guide elements between the inoperative and operative positions.

7. Apparatus according to claim 6, wherein the movement control means comprises cam and cam follower means (11, 17, 22; 25, 26, 27, 31) moving in synchronism with the rotation of the drum, the cam follower being coupled to the cross bar (15, 20; 35, 36) to effect pivoting, rocking movement thereof upon passage of the grippers.

8. Apparatus according to claim 7, wherein (FIG. 1) the cams (11) are secured to the cross strut (9) connecting the chains and supporting the grippers (10) to engage the cam followers upon passage of the grippers beneath the sheet guide elements.

9. Apparatus according to claim 7, wherein (FIG. 2) the cam comprises a cam disc (25) secured to the drum or cylinder (7) and rotating in synchronism therewith, the cam followers being engaged by a camming surface (26) thereof to control pivoting, rocking movement of said cross bar and hence movement of the sheet guide elements between inoperative and operative positions.

10. Apparatus according to claim 1, wherein a plurality of sheet guide elements are provided, positioned along the path of the chain;

and the movement control means are connected to and control movement of each of the sheet guide elements in synchronism with rotation of the drum, or cylinder, and thus also of movement of the chain to move the sheet guide elements to inoperative position upon passage of the grippers past the sheet guide element.

* * * * *